US009957751B2

(12) United States Patent
van't Zelfde et al.

(10) Patent No.: US 9,957,751 B2
(45) Date of Patent: May 1, 2018

(54) BLIND ASSEMBLY AND METHOD OF ATTACHING A SHADE MATERIAL TO A WINDING CORE OF A BLIND

(71) Applicant: Hunter Douglas Industries B.V., Rotterdam (NL)

(72) Inventors: Adrianus Jacob van't Zelfde, Rotterdam (NL); Hans de Lange, Rotterdam (NL)

(73) Assignee: HUNTER DOUGLAS INDUSTRIES B.V., Rotterdam (NL)

( * ) Notice: Subject to any disclaimer, the term of this patent is extended or adjusted under 35 U.S.C. 154(b) by 0 days. days.

(21) Appl. No.: 14/741,632

(22) Filed: Jun. 17, 2015

(65) Prior Publication Data

US 2015/0361717 A1 Dec. 17, 2015

(30) Foreign Application Priority Data

Jun. 17, 2014 (NL) ..... 1040854

(51) Int. Cl.
*E06B 9/44* (2006.01)
*E06B 9/40* (2006.01)
(Continued)

(52) U.S. Cl.
CPC ..... *E06B 9/40* (2013.01); *E04F 10/0666* (2013.01); *E06B 9/42* (2013.01); *E06B 9/44* (2013.01); *Y10T 29/49828* (2015.01)

(58) Field of Classification Search
CPC ..... E06B 2009/2482; E06B 2009/543; E06B 9/40; E06B 9/42; E06B 9/44;
(Continued)

(56) References Cited

U.S. PATENT DOCUMENTS 3,018,824 A 1/1962 Anderson et al.
3,469,695 A 9/1969 Greeninger
(Continued)

FOREIGN PATENT DOCUMENTS

DE 2039936 A1 2/1972
DE 2601663 A1 7/1977
(Continued)

OTHER PUBLICATIONS

"Sag Analysis of an Automotive Roller Blind System in Terms of the Variation in the Production Process", 5th European HyperWorks Technology Conference (EHTC), Nov. 7-9, 2011, Bonn, Germany, 8 Pages.

*Primary Examiner* — Blair M Johnson
(74) *Attorney, Agent, or Firm* — Dority & Manning, P.A.

(57) ABSTRACT

Blind assembly comprising a shade material, a winding core and/or a bottom rail, and compensation means. The shade material is attached to the winding core and/or the bottom rail by attaching the compensation means to the shade material in a first condition in which the compensation means extend along a first line with a first shape. The compensation means can be attached to the winding core and/or the bottom rail in a second condition in which the first line has a second shape, different from the first shape. As a result, the shade material is loaded with compensation forces that can counteract any sagging forces exerted on the shade material by the sagging winding core and/or bottom rail.

14 Claims, 6 Drawing Sheets

(51) Int. Cl.
*E06B 9/42* (2006.01)
*E04F 10/06* (2006.01)

(58) Field of Classification Search
CPC . E06B 2009/445; B60J 1/2041; B60J 1/2061; B60J 1/2072; B60J 11/02
USPC ..... 160/383, 384, 385, 388, 389, 265, 264, 160/328, 329, 374, 378, 262, 58.1; 296/97.8, 142
See application file for complete search history.

(56) References Cited

U.S. PATENT DOCUMENTS 3,601,912 A * 8/1971 Dubbs ..... B41F 15/36 101/127.1
3,724,524 A 4/1973 Potter
4,103,445 A 8/1978 Smith et al.
4,525,909 A * 7/1985 Newman ..... B41F 15/36 101/127.1
5,320,154 A 6/1994 Colson et al.
5,443,003 A * 8/1995 Larson ..... B41F 15/36 101/126
5,522,314 A * 6/1996 Newman, Jr. ..... B41F 15/36 101/127.1
5,671,795 A 9/1997 Keil
6,098,692 A 8/2000 Dieckmann
6,331,223 B1 12/2001 Wylie
6,902,141 B2 6/2005 Kirby
7,752,963 B1 * 7/2010 Niswonger ..... B41F 15/36 101/127.1
7,866,261 B2 * 1/2011 Newman, Jr. ..... B41N 1/241 101/128.1
8,127,821 B2 * 3/2012 Hsu ..... E06B 9/262 160/108
8,149,509 B2 4/2012 Howes
8,544,384 B1 * 10/2013 Niswonger ..... B41F 15/34 101/127.1
2003/0019588 A1 1/2003 Schmitz
2005/0077017 A1 4/2005 Ramsey
2010/0043987 A1 * 2/2010 Hicks ..... E06B 9/54 160/378
2012/0018105 A1 1/2012 Lin
2012/0061040 A1 3/2012 Licciardi Di Stefano
2013/0306255 A1 11/2013 Ng

FOREIGN PATENT DOCUMENTS

DE 102007044515 A1 3/2009
DE 102010034614 A1 2/2012
EP 1637668 A2 3/2006
EP 2383132 A1 2/2011
EP 2369123 A1 9/2011
EP 2529965 A1 12/2012
JP 10238256 A 9/1998
JP 1181827 A 3/1999
WO 2007/042008 A1 4/2007

* cited by examiner

BLIND ASSEMBLY AND METHOD OF ATTACHING A SHADE MATERIAL TO A WINDING CORE OF A BLIND

CROSS REFERENCE TO RELATED APPLICATION

This application claims priority to Netherlands patent application No. 1040854 filed on Jun. 17, 2014, and entitled "Blind Assembly and Method of Attaching a Shade Material to a Winding Core of a Blind", which is hereby incorporated by reference herein in its entirety.

TECHNICAL FIELD

The invention relates to a blind assembly, more particularly a rollable blind assembly, and a method of attaching a shade material to a winding core of such a blind assembly.

BACKGROUND

Rollable blind assemblies are well known. Typically, they comprise a rotatable winding core and a shade material, arranged to be wound about and unwound from said winding core.

A problem with these known blind assemblies is that the winding core may sag under influence of gravity. This sagging may cause the shade material to ripple and wrinkle as illustrated in FIG. 1.

From DE102010034614 it is known that a shade supporting profile, such as an awning arm or a front rail, may sag during use. This may cause the associated shade material to wrinkle. It is proposed to provide the shade supporting profile in unloaded condition with a predetermined curvature that is neutralized by the sagging of the profile in loaded condition. As a result, the shade supporting profile may have a substantially straight shape during use.

This known solution only works for shade supporting profiles that during use do not alter their orientation with regard to the loading direction. It will not work for a rotating winding core. The predetermined curvature would only neutralize the sagging in one specific orientation of the winding core, in which it is rotated such that the predetermined curvature lies exactly opposite the sagging direction of the winding core. When the winding core is subsequently rotated away from this specific orientation, the predetermined curvature will no longer exactly counterbalance the sagging effects and when rotated over more than 90 degrees, the predetermined curvature will start to aggravate the problem since the predetermined curvature extends in the same direction as the sagging direction. A further problem with this known solution is that the required predetermined curvature may vary per blind assembly, depending on for instance the dimensions and weight of the shade material and/or sagging characteristics of the winding core itself, etc. It is difficult enough to provide a winding core with a specific predetermined curvature. It is practically undoable to provide each winding core with a customized predetermined curvature.

SUMMARY

The present invention aims to provide a more simple solution that can be easily implemented in new blind assemblies and retrofitted in existing blind assemblies.

To this end, according to the present invention, there is provided a method of attaching a shade material to a winding core of a blind assembly. The method includes the step of attaching compensation means to the shade material along a first line with a first shape. The method further includes the step of attaching the compensation means to the winding core and the step of altering the shape of the first line into a second shape, different from the first shape, so as to cause the shade material to become biased in a direction opposite to the sagging direction of the winding core.

The step of altering the shape of the first line may be done prior to, during or after the step of attaching the compensation means to the winding core. The first line's shape may be altered, for instance, by deforming the compensation means, elastically or inelastically, and/or by rearranging the compensation means (in case where the compensation means comprise a plurality of parts).

In contrast to the prior art solution, the method according to the invention does not try to prevent or counteract sagging of the winding core itself. Much rather, the method acts on the shade material. More particular, it neutralizes sagging forces exerted on the shade material by the sagging winding core, by loading the shade material with counteracting compensation forces. These compensation forces may act on the shade material at the same location as the sagging forces, namely there where the shade material is connected to the winding core. Accordingly, with a method according to the invention, the sagging forces (and resulting rippling of the shade material) can be counteracted directly at the source.

Also, with a method according to the invention the compensation forces can always act in the correct direction, despite the continuously changing orientation of the rotating winding core. More particularly, the compensation forces will extend into the portion of the shade material that hangs down from the winding core, i.e. in a vertical plane tangential to said winding core. This corresponds to the plane in which the sagging forces act on the shade material during rotation of the winding core. Accordingly, both forces will act in the same plane and thus can neutralize each other perfectly, if dimensioned properly.

Whilst in particular beneficial in relation to a winding core for reasons explained above, a method according to the invention may also be used for attaching shade material to a bottom rail of a blind assembly to compensate for sagging effects of said bottom rail. Thus, according to an aspect of the invention, a method may be provided of attaching a shade material to a bottom rail of a blind assembly, wherein the method comprises the steps of i) attaching compensation means to the shade material along a first line with a first shape; ii) attaching the compensation means to the bottom rail; and iii) altering the first shape of the first line into a second shape that is different from the first shape. Step iii) may be done during or after step ii).

According to a preferred aspect of the invention step iii) may be done prior to step ii). In such case, the compensation means may be attached to the shade material along a first line with a first shape that is curved wherein the curve may match the sagging curve of the bottom rail. The compensation means may then be re-arranged so as to alter said first shape into a second shape, more particularly a straight line, causing the shade material to become biased in a direction opposite to the sagging direction of the bottom rail. Next, the compensation means may be attached to the bottom rail. With this particular order of the method steps, advantageous use can be made of resilient compensation means, for instance a conventional spline (elongated strip) of a plastic or similar resilient material. This compensation means may be attached to the shade material in a resiliently bent condition in which the means extend along a first line having said curved first shape. Once attached, the bending forces may be released, allowing the compensation means to return to its unbent condition in which the first line has a straight shape. Next, the shade material can be attached to the bottom rail in a conventional way, that is, with the compensation means acting as a conventional spline that may be accommodated in a recess provided in the bottom rail.

According to the present invention, there is also provided a blind assembly comprising a winding core and a shade material. The blind assembly may further include drive means for rotating the winding core so as to wind and unwind the shade material onto, respectively off the winding core. Compensation means may be attached to the shade material in a first condition, in which the compensation means extend along a first line with a first shape. The compensation means are arranged to be brought into a second condition, in which the compensation means can be attached to the winding core and the first line has a second shape, different from the first shape, causing the shade material to be biased in a direction opposite to the sagging direction of the winding core. In other words, by bringing the compensation means from the first condition into the second condition, the shade material becomes loaded with compensation forces that can counteract sagging forces exerted on the shade material due to sagging of the winding core.

According to an aspect of the invention, the second shape of the first line extends in a plane tangential to the outer surface of the winding core, in assembled condition. As a result, the compensation forces may act in said same plane, which in turn will correspond to the plane of the sagging forces. Accordingly, the compensation forces and sagging forces may neutralize each other completely if dimensioned correctly.

According to an aspect of the invention, the compensation means may be a single part, such as an elongated strip or spline that extends across the width of the shade material. Alternatively, the compensation means may include a plurality of discrete, separate parts, such as clips or spline sections of limited length, spaced along the width of the shade material.

According to an aspect of the invention, the compensation means may be attached to the shade material along one continuous attachment region. Alternatively, the compensation means may be attached to the shade material along a plurality of discrete attachment regions. The or each attachment region may have any suitable shape, e.g. line shaped, dot shaped, etc.

From the above it is clear that the feature that the compensation means "extend along a first line" should not be interpreted limited. The term "line" does not mean one continuous, uninterrupted line. It also does not mean that the or each attachment region must be line shaped. Much rather, it means that the or each compensation means is located along or bordered by a first line. This first line may be a continuous line or an interrupted line, e.g. in case where the compensation means comprise a plurality of separate parts and/or in case where the compensation means are attached to the shade material via a plurality of discrete attachment regions.

Preferably, the compensation means are arranged to exert compensation forces on the shade material that are identical to the sagging forces, but reversed in direction. More particularly, the compensation forces may be directed to pull the shade material towards the winding core. The magnitude of the compensation forces may vary along the width of the shade material. The magnitude may be larger in a mid section of the shade material than near the edges thereof. Such a distribution of compensation forces may be achieved by having either the first shape of the first line correspond to the sagging curve of the winding core or the second shape of the first line correspond to the reversed sagging curve of the winding core.

According to a preferred embodiment of the invention, the compensation means may not only serve to bias the shade material with compensation forces, as described above, but may also serve to attach the shade material to the winding core. Both functions, attachment and sagging compensation, may be integrated in a single part, the compensation means. As a result, no separate attachment means will be needed for attaching the shade material to the winding core. This may reduce the number of parts in stock and may simplify assembly.

According to a preferred aspect of the invention, the compensation means are releasably attachable to the winding core. In such way, if it turns out that the compensation means do not fully compensate for the sagging effects, the compensation means can be readily de-assembled, so as to have their shape or arrangement adjusted.

According to an aspect of the invention, the compensation means may further or alternatively be used to attach the shade material to a bottom rail of the blind assembly, without the limitations of claim 1. More particularly, according to an aspect of the invention, a blind assembly may be provided, comprising a shade material, a bottom rail and compensation means, wherein the compensation means are attached to the shade material in a first condition in which the compensation means extend along a first line with a first shape, and wherein the compensation means are arranged to be brought into a second condition, in which the compensation means can be attached to the bottom rail and the first line has a second shape, different from the first shape. The first shape of the first line may be curved. A concave side of the curved first line may face an edge of the shade material that in assembled condition is attached to the bottom rail. The curved first shape of the first line may match a sagging curve of the bottom rail. The second shape may be straight. The compensation means may be releasably attachable to the bottom rail. The compensation means may comprise an elongated strip or spline, made of a resilient material, such as a plastic. The spline may be attached to the shade material in a first condition in which the spline is bent, preferably resiliently. After attachment to the shade material, the spline may be allowed to return to a second condition in which the spline is straight. The bottom rail may be provided with at least one recess for accommodating the compensation means.

BRIEF DESCRIPTION OF THE FIGURES

To explain the invention, exemplary embodiments thereof will hereinafter be described with reference to the accompanying drawings, wherein.

DETAILED DESCRIPTION

Figure 1:
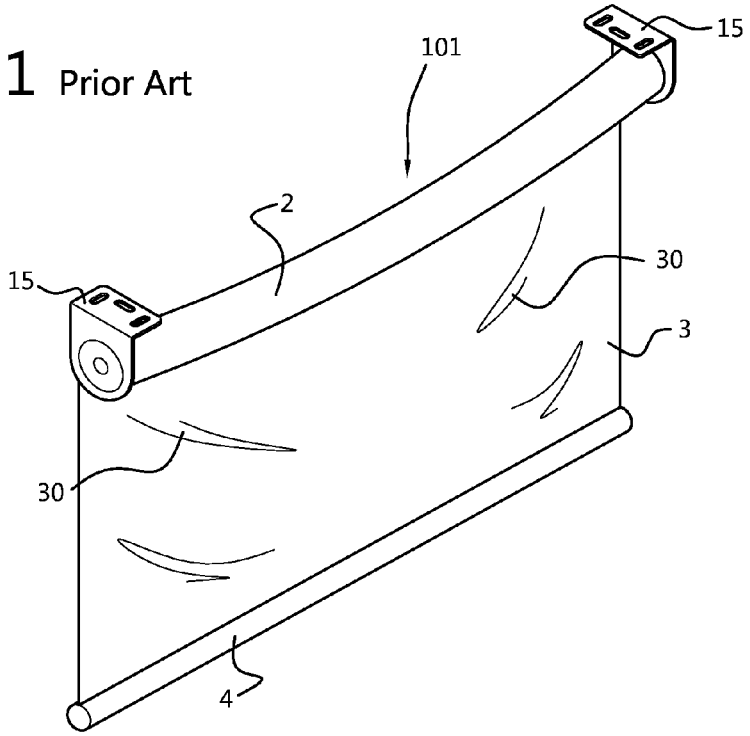
Fig. 1 Prior Art
FIG. 1 shows a prior art blind assembly.
Figure 2:
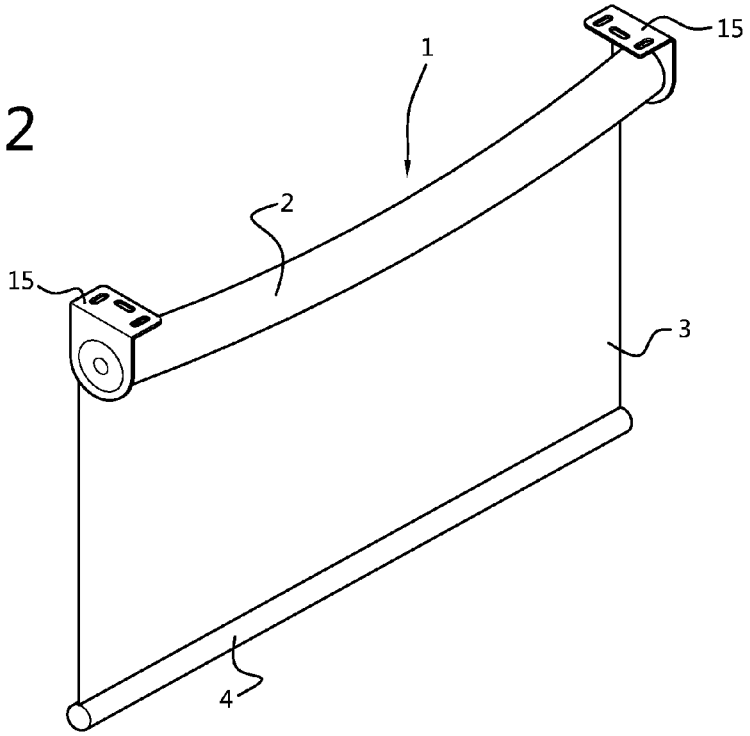
FIG. 2 shows a blind assembly according to the invention.

FIGS. 1 and 2 respectively show a prior art blind assembly 101, and a blind assembly 1 according to the invention. Both blind assemblies 101, 1 are rollable blind assemblies, including a winding core 2 and a shade material 3 suspended therefrom. In the embodiment of FIG. 1, the shade material 3 is attached to the winding core 2 in a conventional manner, without compensation means. The shade material 3 is seen to feature ripples 30 when the winding core 2 sags (which in FIG. 1 has been depicted in exaggerated form). In the embodiment of FIG. 2, the shade material 3 is attached to the winding core 2 with compensation means according to the invention. As a result, the shade material 3 is seen to feature no ripples when the winding core 2 sags (again depicted in exaggerated form).

Figure 3:
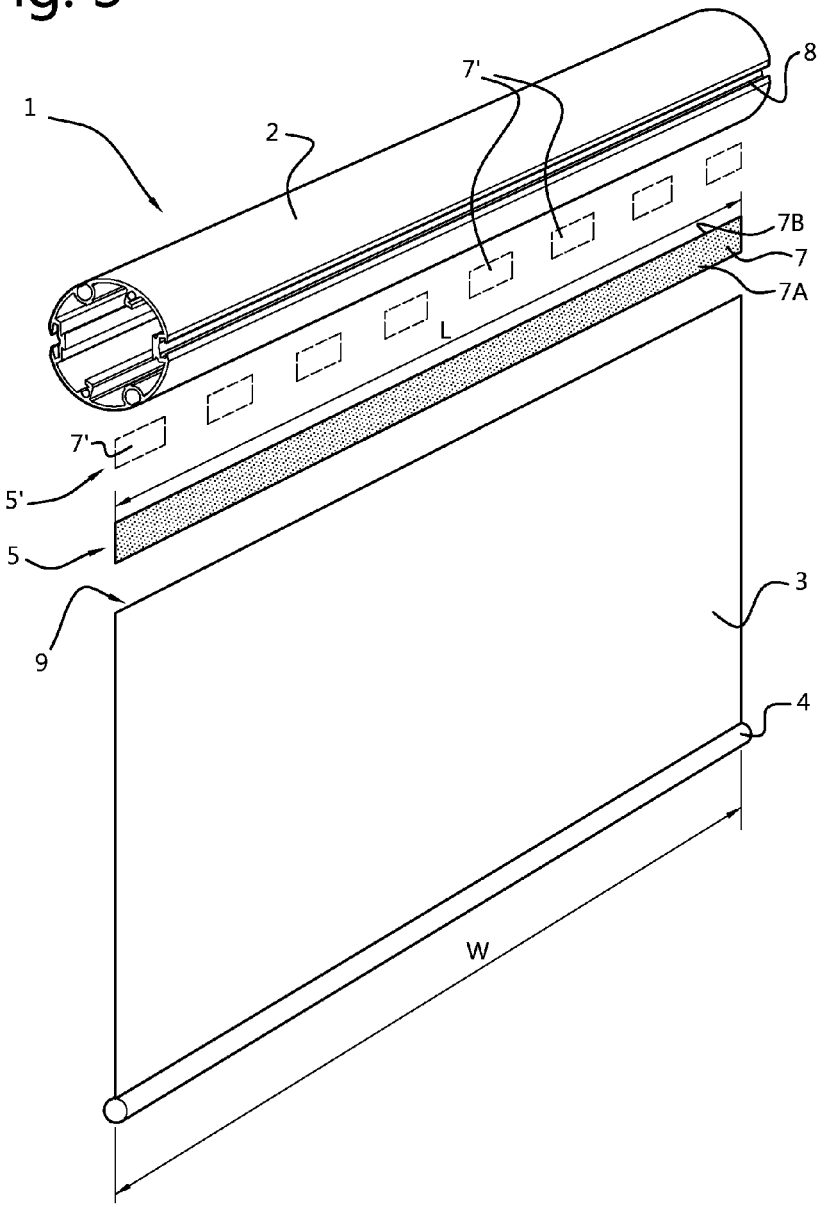
FIG. 3 shows an embodiment of a blind assembly according to the invention, in disassembled condition.

FIG. 3 shows the blind assembly 1 of FIG. 2 in disassembled condition. The blind assembly 1 comprises a winding core 2, a shade material 3 and compensation means 5.

The blind assembly 1 may further comprise mounting means for mounting the blind assembly 1 to an architectural structure. The mounting means may for instance comprise brackets 15 (see FIG. 2) in which the winding core 2 can be rotatably supported. Additionally or alternatively, the mounting means may for instance comprise a cassette or an L-shaped, C-shaped or other suitably shaped mounting profile (not shown, but conventional).

The blind assembly 1 may further comprise drive means (not shown) for rotating the winding core 2 to wind and unwind the shade material 3. The drive means may for instance comprise a drive wheel, operatively connected to the winding core 2 and operable by a user via a ball chain, a retractable single pull cord mechanism or the like. The drive means may alternatively or additionally comprise a motor and/or biasing means such as a spring, arranged to bias the winding core 2 in a wind-up direction. Such biasing means may be combined with balancing means, such as for instance a tension cord arrangement (not shown, but conventional), to counteract at least part of the biasing forces, thus balancing the forces on the shade material 3 and allow it to be extended in any desired position.

The winding core 2 may comprise a roller tube, as shown in FIG. 3, with a length that is substantially equal to or slightly larger than a width W of the shade material 3. Alternatively, the winding core 2 may comprise a plurality of pulleys or rollers of limited length, mounted for rotation on a common drive shaft.

The shade material 3 may comprise any type of material that can be wound about the winding core 2. For instance, the shade material 3 may include a single sheet of a flexible material such as a woven or nonwoven fabric. Optionally, the sheet may be provided with vanes which may be non-tiltable as for instance described in WO2010/059581, or tiltable between an open and closed position as for instance described in WO2005/019584, both of applicant. Alternatively, the shade material 3 may comprise several layers of sheets, which may be unconnected. Alternatively, such layers may be interconnected, e.g. by means of one or more interlaced filaments as for instance described in EP1088920, or by means of vanes as for instance described in EP0482793, both of applicant. The shade material or anyone of its constituting layer(s) and/or vanes as described above may be opaque, (semi) transparent, room darkening or have blackout properties. The shade material may be suitable for internal or external use.

A bottom rail 4 may be provided near a lower edge of the shade material 3, to help keeping the shade material 3 taut.

According to an embodiment of the invention the compensation means 5 may comprise a spline 7, as illustrated in FIG. 3. The spline 7 may comprise a thin, elongated, rectangular strip with a front face 7A and a rear face 7B. The spline 7 may be made of plastic, wood, metal or the like material. The spline preferably has a length L that corresponds to the width W of the shade material 3. The spline preferably has a stiffness that is somewhat larger than that of the shade material 3.

According to an alternative embodiment, the compensation means 5' may comprise a plurality of discrete, separate parts, such as for instance clips, rings, strip segments of limited length 7' or the like, as schematically depicted in FIG. 3, in dotted lines.

The compensation means 5, 5' may be attached near a first or upper edge 9 of the shade material 3. This may be accomplished via any conventional fastening technique such as sewing, weaving, stapling, piercing, bonding, melting, clamping, (double sided) tape, Velcro®, adhesive or the like.

The compensation means 5, 5' may be attached to the winding core 2 via a similar fastening technique as listed above. Alternatively or additionally, the winding core 2 may be provided with a recess 8, as illustrated in FIG. 3. Preferably, the recess 8 is designed to receive the compensation means 5, 5' and maintain it or them in position.

According to an important aspect of the invention, the compensation means 5, 5' are attached to the shade material 3 in a first condition and attached to the winding core 2 in a second condition. In the first condition, the compensation means 5, 5' extend along a first line 11 having a first shape. In the second condition, the compensation means 5, 5' extend along the first line 11 having a second shape, which is different from the first shape. For instance, the shape of the first shape may be changed from initially curved to straight or vice versa. The change in shape (form first to second shape) may be accomplished by deforming the compensation means 5, 5' or, where there is a plurality of compensation means 5', by rearranging their relative respective positions. This feature will now be explained in further detail, by means of some exemplary embodiments.

According to a first embodiment, the compensation means 5 may be attached to the shade material 3 in a first condition in which the compensation means 5 are deformed, preferably elastically deformed, so as to extend along a first line 11 with for instance a curved first shape. After attachment to the shade material 3, the compensation means 5 may be returned to an undeformed second condition, in which they may be attached to the winding core 2. During the transition from the deformed first condition to the undeformed second condition, the first line 11 may change in shape, e.g. from its curved first shape to a second shape, which may for instance be straight.

Figure 4:
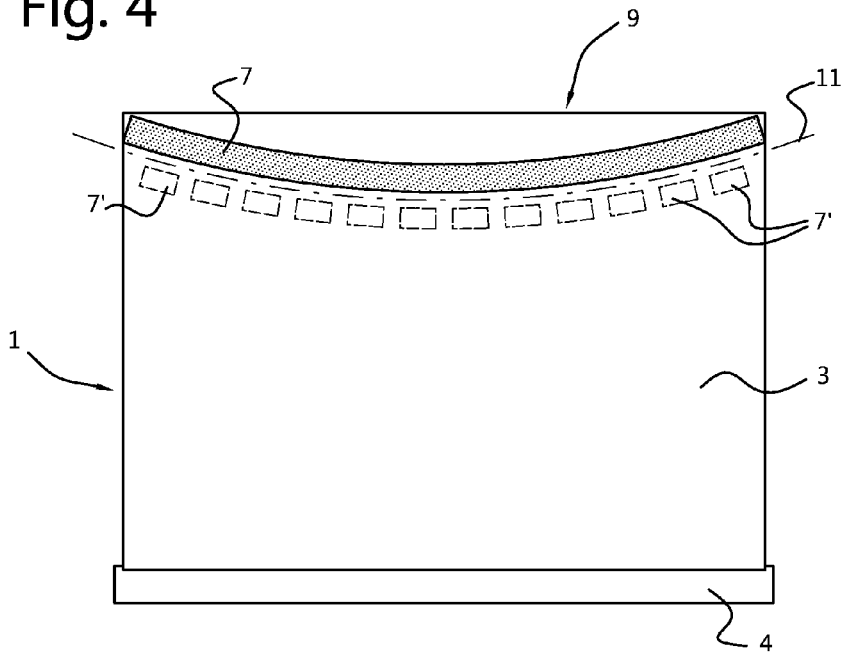
FIG. 4 shows the blind assembly of FIG. 3 during the step of attaching the compensation means to the shade material according to one embodiment of the present invention.
Figure 5:
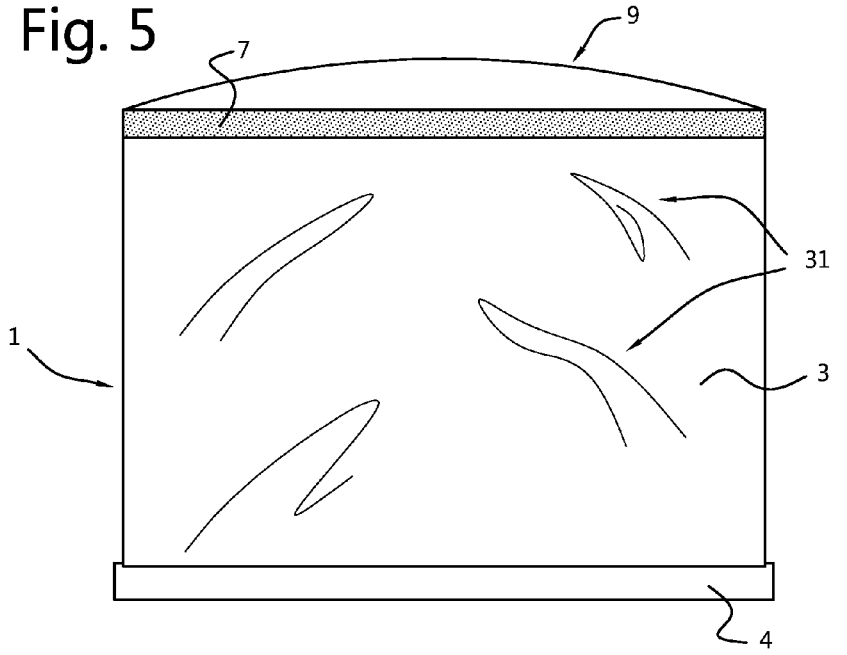
FIG. 5 show the blind assembly of FIG. 4 after the compensation means have been attached to the shade material and prior to being attached to the winding core.

This is illustrated in FIGS. 4 and 5. More particularly, FIG. 4 shows how the spline 7 of FIG. 3 is attached to the shade material 3 in a bent first condition, in which the spline 7 extends along the first line 11 having a curved first shape. To this end, the spline 7 is elastically bent in a plane parallel to its faces 7A,B. This bending can be done by means of a special tool, which will be described hereinafter in further detail with reference to FIGS. 8 to 10. The spline 7 may be bent such that its curvature (or in other words, the first shape of the first line 11) corresponds to that of the winding core 2 when its sags during use. The appropriate curvature may for instance be calculated, simulated, measured, or taken from a data base containing predetermined curvatures for blind assemblies of specific dimensions, shade material, etc. Next, the spline is with one of its faces 7A,B attached to the shade material 3 while being kept in its bent first condition, its concave side facing the upper edge 9 of the shade material 3. Once attached, the bending forces may be released, thus allowing the spline 7 to return to its unbent straight condition, which is accompanied by the first line 11 obtaining a straight second shape. The transition from the first to the second condition causes the shade material 3 to become preloaded with compensation forces and counter ripples 31, as schematically illustrated in FIG. 5. Finally, the spline 7 may be attached to the winding core 2, e.g. by keying the spline 7 into the recess 8. The blind assembly will then look like the blind assembly shown in FIG. 2, with the sagging forces of the winding core being counteracted by the compensation forces and the sagging ripples 30 being neutralized by the counter ripples 31.

The above described embodiment has the advantage that use is made of the inherent elastic properties of the spline 7 to preload the shade material 3. As a result, assembly can be easy. The only difference over existing assembly methods is that the spline needs to be attached to the shade material in a deformed first condition. Once that is accomplished, the spline may automatically return to its straight condition and mounted to the winding core in a conventional way.

Figure 8:
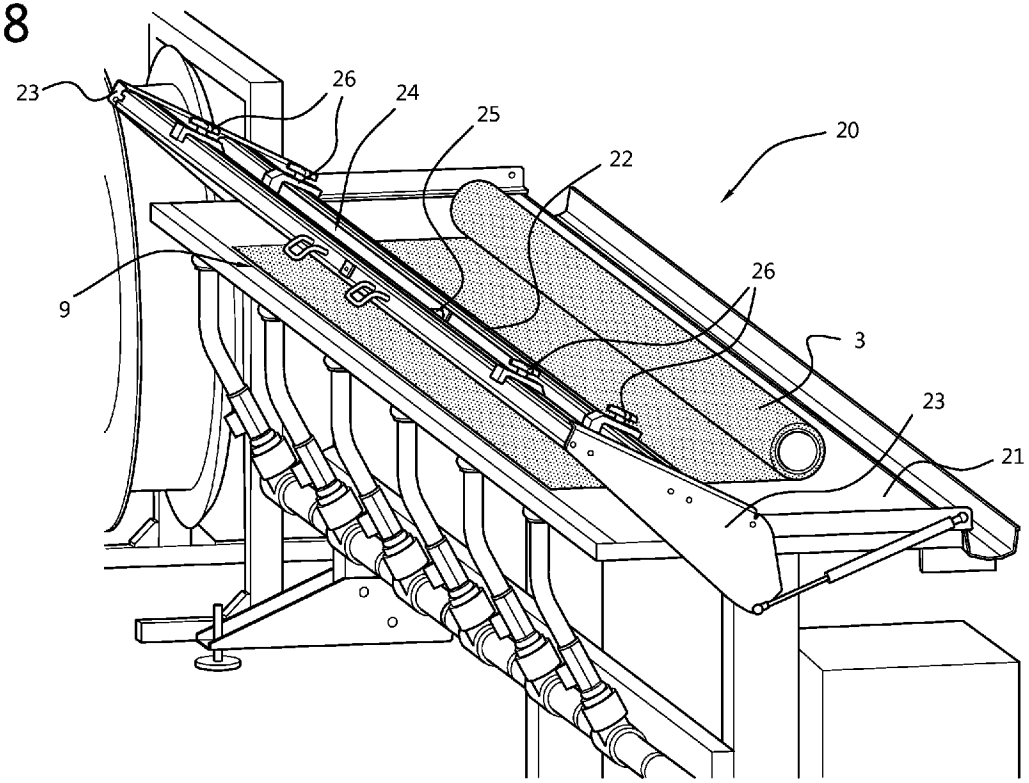
FIG. 8 shows a tool for bringing the compensation means in a bent, first condition.
Figure 10:
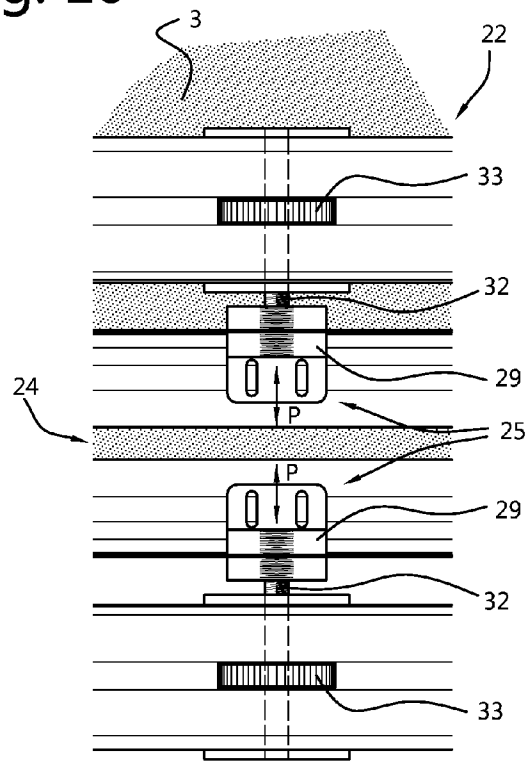
FIG. 10 shows a further detail of the tool of FIG. 8.
Figure 9:
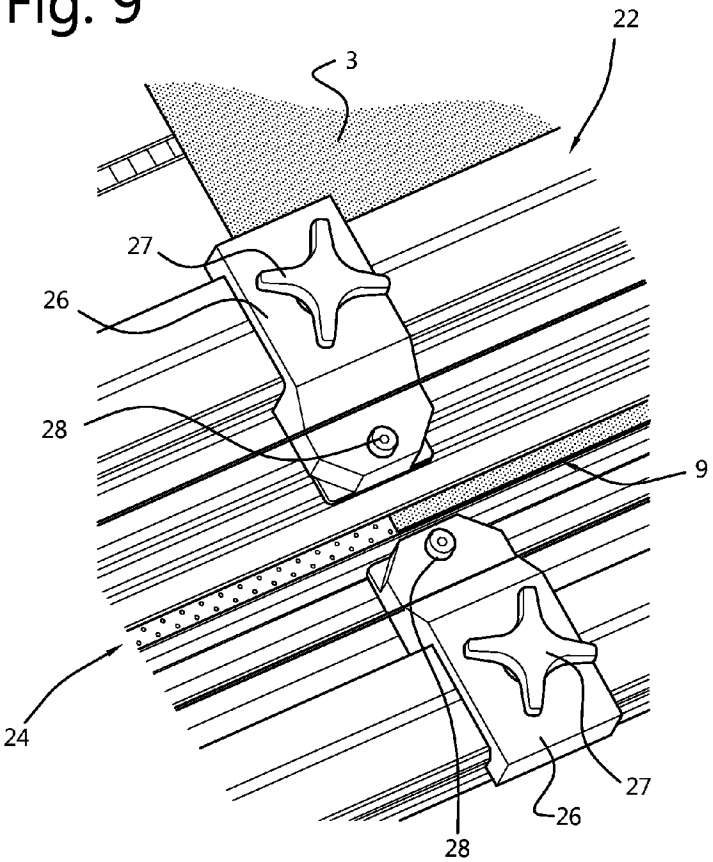
FIG. 9 shows a detail of the tool of FIG. 8.

To assist in the method step of attaching the spline 7 to the shade material 3 in a deformed first condition, a special tool may be used. An embodiment of such a tool 20 is depicted in FIGS. 8 to 10. The tool 20 may comprise a table 21 for supporting the shade material 3, and a positioning beam 22 for bending the spline, and attaching it to the shade material 3 in bent condition. The beam 22 may be maneuverable, e.g. via pivot arms 23, between an inoperative position in which the shade material 3 can readily be positioned onto the table 21, and an operative position, in which the beam 22 rests on top of the table 21, more particularly on top of the shade material 3, near an upper edge 9 thereof, where the spline 7 is to be attached. The beam 22 is provided with a recess 24 for accommodating the spline 7. The beam 22 further comprises a pair of adjustable bending means 25, located opposite to each other, halfway the longitudinal edges of the recess 24, as shown in further detail in FIG. 10. The beam 22 further comprises two pairs of support means 26, mounted at either side of the bending means 25, slidable along the recess 24, as shown in further detail in FIG. 9.

In use, the beam 22 is maneuvered upward, into an inoperative position, as shown in FIG. 8, to allow shade material 3 to be positioned on the table 21. Next, the beam 22 is lowered to an operative position in which it rests on top of the shade material 3, near the upper edge 9 thereof. Then, the support means 26 are slid along the recess 24 to a position where they are aligned with the lateral edges of the shade material 3. Locking means 27 may be provided to arrest the support means 26 in position. Next, the spline 7 is mounted in the recess 24, with one of its faces 7A,B resting on the support means 26, and having its ends flanked by two rounded support pins 28 projecting upward from the respective support means 26. Next, the bending means 25 are adjusted to bend the spline 7 away from the upper edge 9. To that end, each bending means 25 comprises a spindle 32 and a head 29 threaded thereon. The heads 29 can be displaced along said spindles 32, in a direction perpendicular to the longitudinal direction of the recess 24 (as indicated by arrows P) by turning wheels 33 in clockwise or counter clockwise direction. Thus, the heads 29 can be manipulated so as to engage the longitudinal edges of the spline 7 and bend the spline in a plane parallel to its upper and lower faces 7A,B. During this bending step, the ends of the spline are supported laterally by aforementioned pins 28. Once bent, the spline 7 may be attached to the shade material 3 with any suitable fastening means. Finally, the spline 7 may be released by moving the heads 29 of the bending means 25 away from the spline 7 and by sliding the support means 26 sideward, away from the ends of the spline and the edges of the shade material 3. Of course, other tools may be used to attach the compensation means to the shade material according to the invention. Many variations are possible.

According to a variation on the first embodiment (not shown), compensation means 5" may be used, for example a spline 7", that in the first condition is deformed in a non-elastic or only partly elastic way. In such case, upon release of the deformation forces, the compensation means 5", 7" will not automatically and/or fully return to an undeformed, second condition. Additional forces are needed to bring the compensation means 5", 7" into the second condition in which the first line 11 has a second shape that causes the shade material 3 to be loaded with desired compensation forces. These additional forces may for instance be exerted on the compensation means 5", 7" during their attachment to the winding core 2.

According to a further embodiment, the first shape of the first line 11 may be altered to the second shape by rearranging the compensation means 5 between a first and a second condition. In such case, the compensation means may for instance comprise a series of discrete compensation means 5', such as clips or spline segments 7', as schematically shown in FIG. 3 in dotted lines. These compensation means 5' may be attached to the shade material 3, at regularly spaced intervals along a first line 11 having a curved first shape, as illustrated in FIG. 4 in dotted lines. Next, the compensation means 5' may be attached to the winding core 2, for instance mounted in aforementioned recess 8. Alternatively, the compensation means 5' may be attached directly to the outer surface of the winding core 2 via suitable fastening means, such as tape, adhesive or the like. During attachment to the winding core 2, the initially curved first line 11 will adopt a straight second shape, causing the shade material 3 to become preloaded or biased with compensation forces, in a similar way as described before with reference to the previous embodiment. These compensation forces counteract the sagging forces in the shade material 3, resulting in less or no rippling of the shade material 3.

According to another embodiment, the compensation means 5, 5', 5" may be attached to the shade material 3 in an undeformed first condition, along a first line 11 that for instance has a straight first shape. The compensation means 5, 5', 5" may subsequently be attached to the winding core 2 in a deformed second condition, wherein the first line 11 obtains a second shape which may for instance be curved and as a result the shade material 3 becomes loaded with compensation forces.

Figure 6:
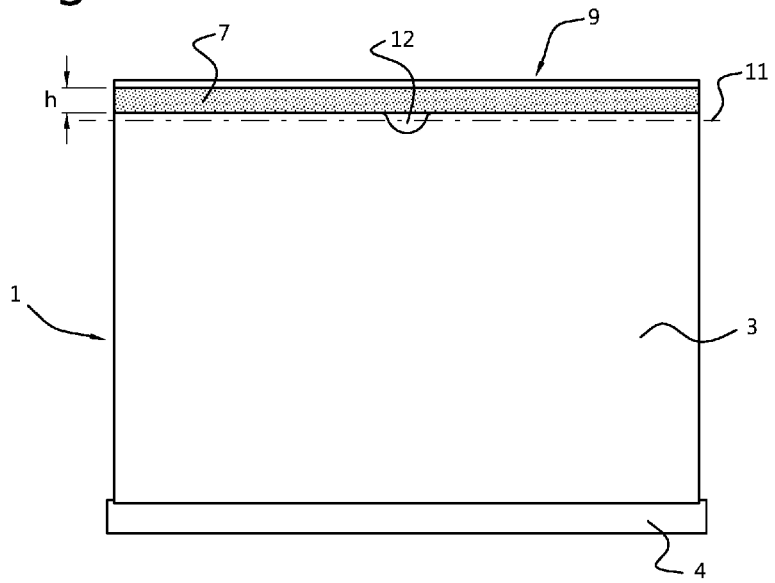
FIG. 6 shows a further embodiment of the invention, with the compensation means already attached to the shade material, but prior to being attached to the winding core.
Figure 7:
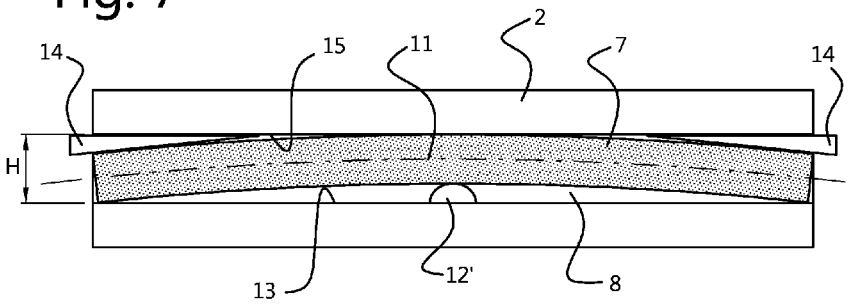
FIG. 7 shows the embodiment of FIG. 6, in further detail, with the compensation means being attached to the winding core and with the shade material removed, for the sake of clarity.

This is illustrated in FIGS. 6 and 7. More particularly, FIG. 6 shows how a spline 7 may be attached to the shade material 3 along a straight line 11, parallel to the upper edge 9. The spline 7 may subsequently be inserted in the recess 8 of the winding core 2 and be deflected so as to be curved with its convex side facing said upper edge 9, as illustrated in FIG. 7. To that end, the spline 7 may be provided with a projecting pivot means 12, about halfway its side that faces away from the upper edge 9 of the shade material 3 (see FIG. 6). Alternatively, the recess 8 may be provided with a projecting pivot means 12', about halfway a first inner wall 13, as illustrated in FIG. 7. The dimensioning is such that in assembled condition, the spline 7 and pivot means 12, 12' together fit snugly within the recess 8, with the pivot means 12, 12' urging the spline 7 against the second inner wall 15 of the recess 8. Next, wedge means 14 may be inserted in the open ends of the recess 8, between the spline 7 and said second inner wall 15. This causes the spline 7 to become bent, as illustrated in FIG. 7. This, in turn, will cause the shape of the first line 11 to alter from straight (as shown in FIG. 6) to curved (as shown in FIG. 7) and causes the shade material 3 (which in FIG. 7 is omitted for clarity sake) to become biased with compensation forces.

An advantage of this embodiment is that the curvature of the spline 7 can readily be adjusted by changing the height of the pivot means 12, 12' and/or the wedge angle of the wedge means 14. Thus, the curvature of the spline can be easily customized per blind assembly to match the sagging curvature of the winding core 2 in question. Each blind assembly may come with a set of pivot means 12, 12' and wedge means 14, with a range of different heights and wedge-angles, thus allowing an assembler to mount the spline 7 with such a curvature as may be needed to compensate for the sagging effects of the winding core 2.

The shade material 3 may be attached to the bottom rail 4 via similar compensation means and all embodiments thereof as described above in relation to the winding core 2.

The invention is not in any way limited to the exemplary embodiments presented in the description and drawing.

For instance, in the illustrated embodiments, the compensation means have a double role in that, aside from loading the shade material with compensation forces the means also serve to attach the shade material to the winding core. In alternative embodiments, both functions may be performed by separate parts, i.e. in addition to the compensation means, separate attachment means may be provided for attaching the shade material to the winding core.

The blind assembly may be for internal or external use.

All combinations (of parts) of the embodiments shown and described are explicitly understood to be incorporated within this description and are explicitly understood to fall within the scope of the invention. Moreover, many variations are possible within the scope of the invention, as outlined by the claims.

The invention claimed is:

1. A blind assembly comprising:

a shade material having a top edge and a bottom edge;

a winding core including a first end and a second end and defining a length extending between said first and second ends, said winding core coupled to said shade material at or adjacent to said top edge of said shade material, said winding core rotatable to move said shade material between a retracted position and an extended position, said winding core sagging downward in a vertical direction between said first and second ends of said winding core along a sagging curve with respect to a non-curved reference line extending in a horizontal direction between said first and second ends; and a compensation member configured to be releasably coupled to said winding core, said compensation member coupled to said shade material along a compensation curve selected based on the sagging curve of said winding core such that said compensation member preloads said shade material with compensation forces to counteract sagging of said winding core in the vertical direction.

2. The blind assembly according to claim 1, wherein a magnitude of the compensation forces varies along a horizontal width of said shade material.

3. The blind assembly according to claim 1, wherein the compensation forces are maximal near a mid section of said shade material and minimal near lateral edges of said shade material.

4. The blind assembly according to claim 1, wherein, when said compensation member is straightened from the compensation curve, said compensation member extends in a plane tangential to an outer surface of said winding core.

5. The blind assembly according to claim 1, wherein said compensation member is releasably attachable to said winding core.

6. The blind assembly according to claim 1, wherein said compensation member comprises an elongated strip, wherein said elongated strip is a spline.

7. The blind assembly according to claim 1, wherein said winding core includes a recess and said compensation member is attached to said winding core by being received within said recess.

8. The blind assembly according to claim 1, further comprising:

a bottom rail including a first end and a second end and defining a length extending between said first and second ends of said bottom rail, said bottom rail attached to said shade material at or adjacent to said bottom edge of said shade material, said bottom rail configured to sag downward in the vertical direction between said first and second ends of said bottom rail along a second sagging curve with respect to a second non-curved reference line extending in the horizontal direction between said first and second ends of said bottom rail; and a second compensation member attached to said shade material along a second compensation curve selected based on the sagging curve of said bottom rail.

9. A blind assembly comprising:

a shade material having a top edge and a bottom edge;

a winding core coupled to said shade material, said winding core rotatable to move said shade material between a retracted condition and an extended condition;

a bottom rail including a first end and a second end and defining a length extending between said first and second ends, said bottom rail attached to said shade material at or adjacent to said bottom edge of said shade material, said bottom rail sagging downward in a vertical direction between said first and second ends of said bottom rail along a sagging curve with respect to a non-curved reference line extending in a horizontal direction between said first and second ends; and a compensation member configured to be releasably coupled to said bottom rail, said compensation member coupled to said shade material along a compensation curve selected based on the sagging curve of said bottom rail such that said compensation member preloads said shade material with compensation forces to counteract sagging of said bottom rail.

10. A method of assembling a blind assembly, said blind assembly including a shade material and a winding core rotatable to move said shade material between a retracted position and an extended position, said winding core defining a sagging curve between opposed ends of said winding core in a vertical direction when said shade material is moved to said extended position, the method comprising:

resiliently bending a compensation member such that said compensation member defines a compensation curve along its length that corresponds to the sagging curve of said winding core;

attaching said compensation member to said shade material while said compensation member is bent along the compensation curve;

straightening said compensation member to a straightened condition to couple said compensation member to said winding core; and attaching said compensation member to said winding core when said compensation member is in said straightened condition;

wherein said compensation member preloads said shade material with a compensation force to counteract sagging of said winding core in the vertical direction when said compensation member is disposed in said straightened condition.

11. The method of claim 10, further comprising:

resiliently bending a second compensation member such that said second compensation member defines a second compensation curve along its length that corresponds to a sagging curve of a bottom rail of the blind assembly; and attaching said second compensation member to said shade material while said second compensation member is bent along the second compensation curve.

12. The method of claim 11, further comprising coupling said second compensation member to said bottom rail.

13. The method of claim 10, wherein attaching said compensation member to said winding core includes inserting said compensation member into a recess in said winding core such that said compensation member extends in a horizontal direction.

14. The method of claim 11, wherein said second compensation member preloads said shade material with a second compensation force to counteract sagging of said bottom rail.

* * * * *